US006068470A

United States Patent [19]

Zarzalis et al.

[11] Patent Number: 6,068,470

[45] Date of Patent: May 30, 2000

[54] DUAL-FUEL BURNER

[75] Inventors: Nikolaos Zarzalis, Dachau; Klaus Merkle, Karlsruhe; Wolfgang Leuckel, Dürkheim, all of Germany

[73] Assignee: MTU Motoren-und Turbinen-Union Munich GmbH, Munich, Germany

[21] Appl. No.: 09/240,477

[22] Filed: Jan. 29, 1999

[30] Foreign Application Priority Data

Jan. 31, 1998 [DE] Germany ..... 198 03 879

[51] Int. Cl.[7] ..... F23C 7/00; F23D 11/16; B05B 7/10; B05B 7/06

[52] U.S. Cl. ..... 431/187; 431/182; 431/284; 239/403; 239/422; 239/424; 239/428

[58] Field of Search ..... 431/187, 181, 431/8, 9, 182, 284, 285, 174, 175; 239/399, 400, 403, 422, 423, 424, 428, 427.3, 427.5, 434.5; 60/737, 748

[56] References Cited

U.S. PATENT DOCUMENTS

| | | | |
|---|---|---|---|
| 3,897,200 | 7/1975 | Childree | 431/285 |
| 4,311,277 | 1/1982 | Stratton | 239/400 |
| 4,600,151 | 7/1986 | Bradley | 239/400 |
| 4,842,197 | 6/1989 | Simon et al. | 239/400 |
| 5,062,792 | 11/1991 | Maghon | 431/284 |
| 5,373,693 | 12/1994 | Zarzalis et al. | 60/748 |
| 5,404,711 | 4/1995 | Rajput | 239/400 |
| 5,417,070 | 5/1995 | Richardson | 60/748 |
| 5,496,170 | 3/1996 | Primdahl et al. | 431/187 |
| 5,782,626 | 7/1998 | Joos et al. | 431/187 |

FOREIGN PATENT DOCUMENTS

| | | |
|---|---|---|
| 2820702 C2 | 11/1978 | Germany . |
| 196 27 760 A1 | 1/1998 | Germany . |

*Primary Examiner*—Ira S. Lazarus
*Assistant Examiner*—Josiah C. Cocks
*Attorney, Agent, or Firm*—Hill & Simpson

[57] ABSTRACT

The present invention provides dual-fuel burners for the oxidation of liquid and of gaseous fuel with air. A dual-fuel burner is provided with an atomizer nozzle which generates a divergent spray cone of liquid fuel, and with an annular atomizer lip as an impact member for the liquid fuel spray cone. The dual-fuel burner has a primary channel for a first air stream through the spray cone and the inside of the atomizer lip, and a secondary channel for a second air stream over the outside of the atomizer lip with a common, coaxial mouth at an atomizer edge thereof. A channel for the gaseous fuel leads into the inside of the atomizer lip between the primary and secondary channels and discharges into one or both of the primary and secondary channels upstream of the atomizer edge.

8 Claims, 1 Drawing Sheet

DUAL-FUEL BURNER

FIELD OF THE INVENTION

The present invention is generally directed to a dual-fuel burner for the oxidation of liquid fuel with air and gaseous fuel in combustion chambers.

BACKGROUND OF THE INVENTION

A burner of the species designed for single-fuel operation with liquid fuel is disclosed by German patent document no. 196 27 760 A1. This burner concept provides homogeneous distribution of an air-fuel mixture in the combustion space for the reduction of pollutant emissions. The divergent spray cone of an atomizer nozzle is directed onto an atomizer lip acting as an impact member at whose inside a fuel film moving downstream forms. The fuel film migrates up to an atomizer edge at the back end of the atomizer lip, where, due to an air guidance with two uniting airstreams (primary and secondary air streams) as well as a local cross-sectional constriction, it is subject to high shearing forces. The fuel film is especially finely and homogeneously atomized. The preferred application of this burner ensues in kerosene-operated aircraft gas turbines.

Stationary gas turbines are being employed to an increasing extent as rapidly connectible and disconnectible power machines in power plants for generating power, for example power for peak loads. Turbines capable of operation with gaseous fuel and with liquid fuel are being demanded more and more in view of a desire for unrestricted readiness to produce power. For example, natural gas is provided for "normal" operation and light heating oil is provided for an "emergency operation". Operating conditions can also occur where both fuels are simultaneously supplied. In addition to this specific application, a gas turbine having a "dual-fuel mode" can offer advantages in various burner applications.

A burner arrangement that can be optionally operated with liquid or gaseous fuel is already disclosed by German patent document no. 28 20 702 C2. In its center, this burner comprises a mixing ring with a mixing surface to which a spray fog of liquid fuel can be supplied with an air stream and from which the fuel-air mixture enters into the mixing ring. Gaseous fuel can be introduced in an air stream proceeding from the underside of the mixing ring. A column operation of both fuels is not provided.

SUMMARY OF THE INVENTION

One object of the invention is to provide a new dual-fuel burner which is suitable for operation with liquid fuel and with gaseous fuel while maintaining positive fuel burning properties.

The present invention pertains to burners for the oxidation of liquid fuel with air, particularly for use in combustion chambers of stationary gas turbines. One such burner includes an atomizer nozzle for the fuel and generates a divergent spray cone. An annular atomizer lip is concentric to the nozzel axis and forms an impact member for the spray cone. A primary channel conducts a first air stream to the spray cone as well as through the inside cross-section of the atomizer lip. A second channel conducts a second air stream over the outside of the atomizer lip and brings the second air stream together as an envelope stream with the first air stream. In an embodiment as a dual-fuel burner, a channel for gaseous fuel leads into the inside of the atomizer lip between the primary and secondary channels and discharges into the primary channel and/or into the secondary channel upstream of the atomizer edge which forms a back end of the atomizer lip.

When the burner has at least temporary simultaneous operation with the liquid and with gaseous fuel, the channel for the gaseous fuel discharges either only into the secondary channel or into the primary and secondary channels upstream of the atomizer edge.

When the burner is in a temporarily offset operation with liquid or with gaseous fuel, the channel for the gaseous fuel discharges into the primary channel upstream of the atomizer edge.

The channel for the gaseous fuel may further include an interconnect, annular flow cross-section and/or a plurality of individual flow cross-sections, particularly a plurality of bores, in the exit region.

Each of the primary and secondary channels may have its entry side provided with a twist generator, for example, in the form of baffle paddles, in which the twist in the channels is isodirectional or oppositely directed. The secondary channel may have a convergent—divergent outside contour upstream of the twist generator and positioned at a narrowest cross-section thereof residing at at least approximately the same axial position as the atomizer edge.

The present dual-fuel burner invention provides an additional channel for the gaseous fuel which is conducted into the inside of the atomizer lip and discharges into the primary and/or into the secondary channel upstream of the atomizer edge, i.e. the location that ultimately determines the fuel processing. The additional channel can be largely arbitrarily designed and can be sectionally composed of a plurality of interacting individual channels (for example, bores). The gas admixture close to the atomizer edge assures a homogeneous blending of the fuel components given adequate cooling of the burner—without a flashback of the flame front into the air channels.

DETAILED DESCRIPTION OF PRESENTLY PREFERRED EMBODIMENTS

Figure 1:
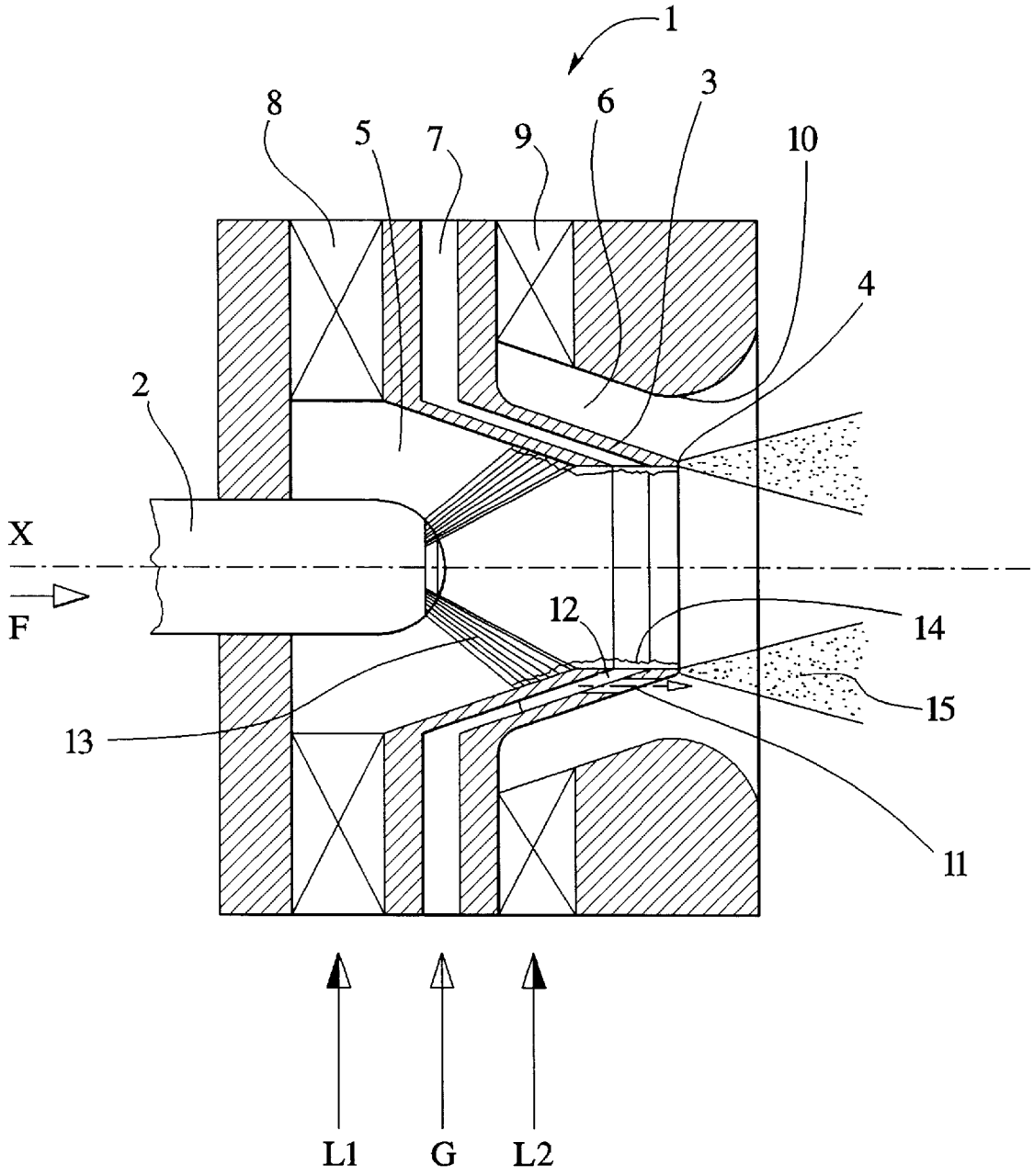
FIG. 1 is a cross-sectional view of a dual-fuel burner according to the principles of the present invention showing two burner variations with different gas admixtures shown with half sections separated by a burner axis.

Although the present invention can be made in many different forms, the presently preferred embodiments are described in this disclosure and shown in the attached drawing. This disclosure exemplifies the principles of the present invention and does not limit the broad aspects of the invention only to the illustrated embodiments.

FIG. 1 shows a dual-fuel burner 1 according to the present invention. The dual-fuel burner 1, whose longitudinal middle axis is referenced X, is supplied with liquid fuel F via an atomizer nozzle 2. The fuel emerges from the atomizer nozzle 2 in the form of a divergent spray cone 13 and impacts the inside surface of an annular atomizer lip 3 that is concentric with respect to the axis X. A fuel film 14 migrating downstream forms thereon, this being converted into a fine, air-permeated fuel fog 15 at the atomizer edge 4 as a consequence of the air flow conditions prevailing at the atomizer edge 4.

Combustion air is conducted through the dual-fuel burner 1 in the form of two initially separate air streams L1 and L2. The first air stream L1 proceeds via a primary, central channel 5 through the spray cone region as a core stream, proceeding to the atomizer edge 4 of the atomizer lip 3. 10 The second air stream L2 proceeds through a secondary, concentric channel 6 via the outside circumference of the atomizer lip 3 to the atomizer edge 4, where, as an envelope stream, it meets the first air stream L1 as well as the liquid fuel. A convergent-divergent outside contour 10 of the secondary channel 6 with a narrowest cross-section in the region of the atomizer edge 4 leads to flow conditions at the region of the atomizer edge that promote the homogenization of the fuel-air mixture.

Isodirectional or oppositely directed twist motions, i.e. components in circumferential direction, can be impressed on the air flows in the channels 5 and 6 with twist generators 8, 9. The twist generators 8, 9 may be baffle paddles, for example.

When the two air streams L1 and L2 meet at the atomizer edge 4, velocity differences in size and direction as well as circumferential components lead to shearing and centrifugal forces, with whose assistance an intimate blending of fuel and air can be achieved. The fuel is desirably converted into optimally small, homogeneously distributed droplets with large oxidizable overall surface area over an optimally short axial mixing path. The mixing zone expands, i.e. highly divergent, to a predetermined cross-section, particularly the cross-section of the combustion chamber, likewise over an optimally short, axial path.

Up to now, the comments primarily refer to the preparation of the liquid fuel.

An additional channel 7 is provided for the gaseous fuel G, this additional channel 7 leads separately into the inside of the atomizer lip 3 between the channels 5 and 6 of the combustion air. From this point, the gaseous fuel is conducted into the primary channel 5, into the secondary channel 6 or into both channels 5, 6 via flow connections upstream of the atomizer edge 4, i.e. is brought together with air and, potentially, with liquid fuel as well. The gaseous fuel also participates in the distribution process initiated at the atomizer edge 4.

When the dual-fuel burner 1 is to be operated either with liquid fuel or with gaseous fuel separated in time, the gaseous fuel, like the liquid fuel, is conducted in the primary, central channel 5. The structural conditions for such separate operate with liquid or gas fuel are shown in the half section of the burner 1 above the axis X. An interconnect, annular opening at the inside of the atomizer lip 3 forms the mouth of the channel 7. A plurality of bores could just as easily form this mouth. The gas exit thus ensues where, during liquid mode, the fuel film 14 moves in the direction of the atomizer edge 4. No interaction between liquid fuel/gas fuel occurs due to the selected operating mode.

The conditions are different given simultaneous, i.e. combined operation with liquid fuel and gas. The structure envisioned for simultaneous fuel operation is shown in FIG. 1 in the half section under the axis X. Because it can be disadvantageous to largely or completely destroy the liquid fuel film 14 due to the gas delivery before this fuel film reaches the atomizer edge 4, the gaseous fuel is conducted partly or only in the secondary channel 6, which is free of liquid fuel. Bores 11 penetrating through the outside wall of the atomizer lip 3 are suitable for this purpose. In addition, bores 12 (broken lines) or other openings can be present that release a part of the gaseous fuel stream through the liquid fuel film.

The liquid fuel film 14 on the atomizer lip surface also provides an important cooling function. Accordingly, it can be advantageous to conduct the gas through the fuel film 14 at a plurality of close proximate locations, so that adequately large, undisturbed film zones remain between these locations.

While the presently preferred embodiments have been illustrated and described, numerous changes and modifications can be made without significantly departing from the spirit and scope of this invention. Therefore, the inventors intend that such changes and modifications are covered by the appended claims.

What is claimed is:

1. A dual-fuel burner for the oxidation of liquid fuel with air and gaseous fuel in a combustion chamber, comprising:

a liquid fuel atomizer nozzle having an axis, and which generates a divergent spray cone of liquid fuel;

an annular atomizer lip concentric to the axis of the atomizer nozzle and forms an impact member for the spray cone;

a primary air stream channel flow connected to an inside of the atomizer lip, the primary air stream channel adapted to conduct a first air stream to the spray cone;

a secondary air stream channel flow connected over an outside of the atomizer lip, the secondary air stream channel adapted to conduct a second air stream to the first air stream; and a gaseous fuel channel between the primary and the secondary air stream channels and flow connected to the atomizer lip, the gaseous fuel channel discharges into at least one of the primary and secondary air stream channels upstream of an atomizer edge of the atomizer lip and downstream of an air flow twist generator in the at least one of the primary and secondary air stream channels.

2. A dual-fuel burner according to claim 1, wherein when during at least temporary simultaneous operation of the dual-fuel burner with the liquid and gaseous fuels, the channel for the gaseous fuel discharges upstream of the atomizer edge to one of 1) only into the secondary channel and 2) into the primary channel and into the secondary channel.

3. A dual-fuel burner according to claim 1, wherein during operation with only gaseous fuel, the gaseous fuel channel discharges into the primary channel upstream of the atomizer edge.

4. A dual-fuel burner according to any one of claims 1–3, wherein the gaseous fuel channel further comprises in an exit region of the gaseous fuel channel one of 1) an annular flow cross-section connected to the primary air stream channel and 2) a plurality of bores connected to the primary air stream channel.

5. A dual-fuel burner according to any one of claims 1–3, wherein each of the primary and secondary air stream channels has a twist generator at an entry side of the respective channel, the twist generators forming isodirectional flow through the primary and secondary air stream channels.

6. A dual-fuel burner according to claim 5, wherein the secondary channel comprises a convergent-divergent outside contour at a narrowest cross-section of the secondary channel, the convergent-divergent outside contour located at approximately the same axial position as the atomizer edge.

7. A dual-fuel burner according to claim 4, wherein each of the primary and secondary channels has a twist generator at an entry side of the respective channel, the twist generators forming isodirectional flow through the primary and secondary channels.

8. A dual-fuel burner according to claim 7, wherein the secondary channel comprises a convergent-divergent outside contour at a narrowest cross-section of the secondary channel, the convergent-divergent outside contour located at approximately the same axial position as the atomizer edge.

* * * * *